US005301444A

United States Patent [19]

Horiuchi

[11] Patent Number: 5,301,444

[45] Date of Patent: Apr. 12, 1994

[54] SWIMMING TOY FISH

[76] Inventor: Shigeyuki Horiuchi, 1168-1 Shimomakuri, Ohaza, Koshigaya-Shi, Saitama-Ken, Japan

[21] Appl. No.: 41,566

[22] Filed: Apr. 2, 1993

[30] Foreign Application Priority Data

Apr. 9, 1992 [JP] Japan ..... 4-029852[U]
Jul. 29, 1992 [JP] Japan ..... 4-058427[U]

[51] Int. Cl.[5] ..... G09F 19/00

[52] U.S. Cl. ..... 40/426; 446/134; 40/406

[58] Field of Search ..... 446/131-136; 273/456; 40/426, 406, 429; 472/67

[56] References Cited

U.S. PATENT DOCUMENTS 1,595,801 8/1926 McDonald ..... 446/134
3,006,111 10/1961 Koch ..... 40/426 X
3,239,956 3/1966 Canonica, Jr. ..... 446/134 X
3,425,157 2/1969 Hartsock ..... 446/134
5,050,876 9/1991 Chuang ..... 446/134 X

FOREIGN PATENT DOCUMENTS 12285 of 1911 United Kingdom ..... 446/134

OTHER PUBLICATIONS

German Patentanmeldung P 12239 XI/77f, Pabler, Nov. 1955.

*Primary Examiner*—Mickey Yu

[57] ABSTRACT

A marine display is provided having a housing and a transparent vessel at least partially filled with liquid. A magnetic animated marine life such as a toy fish is freely suspended in the liquid and at least one rotating magnet in the housing generate magnetic fields which co-act with the magnetic toy fish to cause the fish to move in all directions to simulate the swimming action of a natural fish in a liquid habitat. A background plate in the housing behind the liquid vessel imparts aesthetic marine-like appearance to the display.

18 Claims, 5 Drawing Sheets

SWIMMING TOY FISH

FIELD OF THE INVENTION

This invention relates generally to a display apparatus for animated marine life and is particularly related to a display device comprising a liquid vessel and an animated marine life swimming therein to simulate an aquarium. In one aspect, the present invention relates to a magnetically actuated toy fish swimming freely in an aquatic habitat much like a live fish in the sea or in a liquid environment. In another aspect, this invention is concerned with a display apparatus comprising a liquid medium in which a magnetically actuated toy fish is freely suspended and swims around in different directions simulating the natural swimming movements of a live fish.

BACKGROUND OF THE INVENTION

Magnetically activated animated objects are well known in the art. A magnetically activated toy fish in a display device is described, for example, in U.S. Pat. No. 3,239,956. This patent describes a marine life display apparatus in which an animated toy fish having a magnet therein is freely suspended in a liquid medium and is caused to move about therein in an effort to simulate the swimming movement of a natural fish. In the display device described in said patent, power-driven magnetic means is disposed below the liquid medium in which the toy fish is freely suspended and causes the fish to follow a continuous pattern of undulating movements through the liquid thus simulating the movements of a natural fish.

Other magnetic toy fish are also known. Most of the heretofore known toy fish include a magnetic means and the fish is freely suspended in a liquid medium disposed in a vessel supported on a base or a panel and a magnetic means is disposed below the supporting base. The magnetic means below the supporting base is rotated by a power source thereby varying the magnetic field generated by the magnet and thus activating the toy fish. However, the movements of the toy fish is limited, usually to vertical and horizontal movements and fail to simulate the movements of natural fish, in all directions and without a continuous pattern.

Accordingly, it is an object of this invention to provide an animated marine life, such a toy fish and the like, which is capable of simulating the swimming actions of a natural fish in a liquid habitat.

It is another object of this invention to provide a magnetically activated toy fish which can be freely suspended in a liquid medium and which can be magnetically activated to swim freely in said liquid medium, much like a natural fish swims in a water habitat.

It is a further object of this invention to provide a display apparatus comprising a liquid medium in which a magnet-containing inanimate toy fish is suspended, said display apparatus comprising magnetic means capable of varying the movement of the toy fish in all directions thereby causing the toy fish to have the appearance of a natural fish swimming in a liquid habitat.

It is yet another object of this invention to provide such a display apparatus which simulates an aquarium and which is simple to construct and easy to use for display and aesthetic purposes, in homes, offices and institutions.

The foregoing and other features of this invention will be more readily understood and appreciated from the ensuing detailed description taken in conjunction with the accompanying drawings which form part of this application.

SUMMARY OF THE INVENTION

In order to overcome the deficiencies of the prior art, the present invention provides a marine display in which a magnetic marine object such as a toy fish swims freely to simulate the swimming action of a natural fish in a liquid habitat. The marine display comprises a housing and a transparent liquid vessel which is at least partially filled with a liquid, usually water, and in one embodiment, the liquid vessel has a convex front surface and a generally flat rear surface. A marine object such as a toy fish is freely suspended in the liquid, said toy fish having magnets therein and means for imparting buoyancy to the fish. One or more rotatable magnets disposed in said housing behind the rear surface of the liquid vessel rotate about a horizontal axis thus generating magnetic fields at different speeds. The magnetic toy fish and the rotating magnet or magnets co-act to cause the toy fish to move freely in all directions to simulate the swimming actions of a natural fish in a liquid habitat.

A background plate depicting different scenes, such as a coral reef or a rock case, can be disposed in the housing, behind the rear surface of said liquid vessel to impart a more realistic and natural background scenery for the marine display.

DETAILED DESCRIPTION OF THE DRAWINGS

In the drawings, wherein like reference numerals designate like parts:

DETAILED DESCRIPTION OF THE PREFERRED EMBODIMENTS OF THE INVENTION

Figure 1:
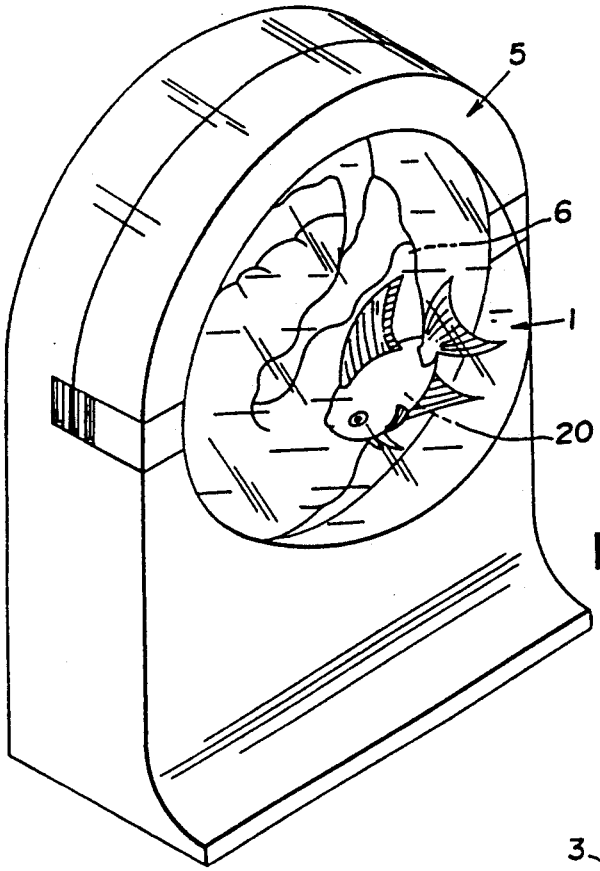
FIG. 1 is a perspective view of the display apparatus of this invention showing the swimming toy fish suspended freely in a liquid vessel.
Figure 2:
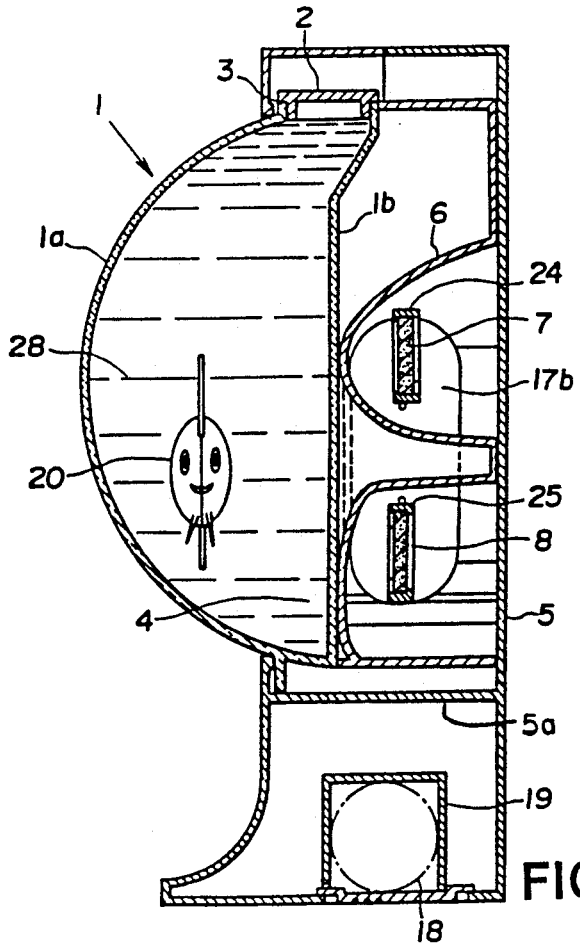
FIG. 2 is a vertical sectional view generally showing the display apparatus of this invention and the swimming toy fish suspended freely in a liquid vessel.
Figure 3:
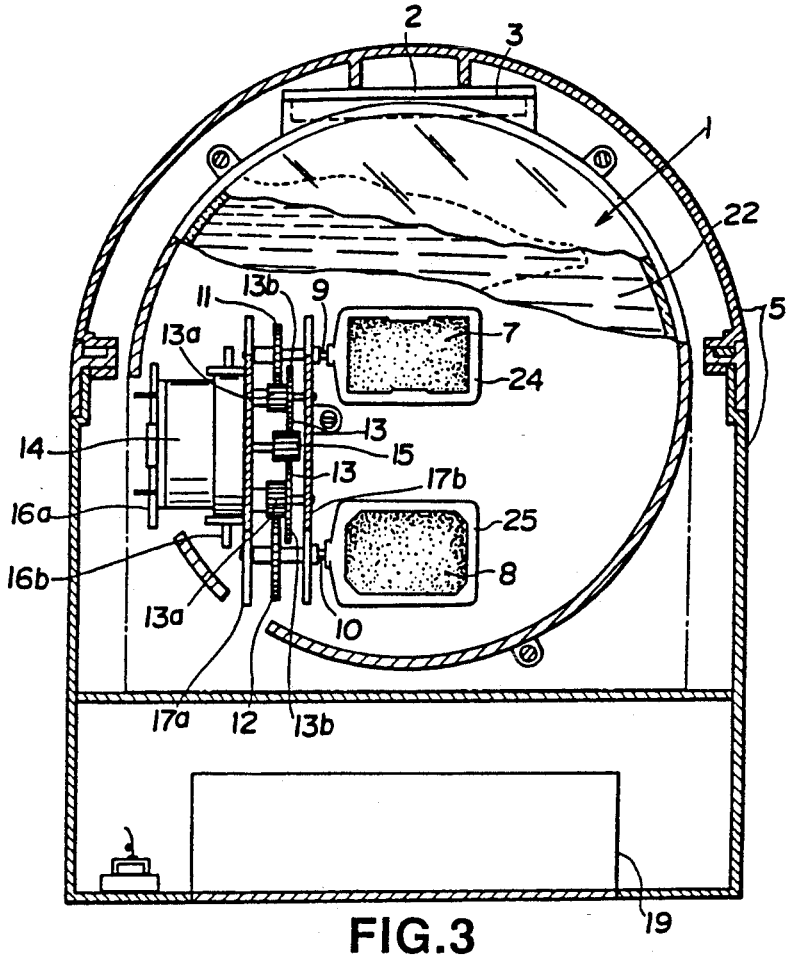
FIG. 3 is an elevational, partly sectional front view of the display apparatus in FIG. 1, with the liquid vessel removed, in order to show the magnetic means and their associated driving assembly used for activating the magnetic swimming toy fish.

Referring to the drawings, and first to FIGS. 1-3, the display apparatus comprises a liquid vessel 1 made of transparent rigid plastic material in the form of a semi-spherical structure having a front convex surface 1*a* and a rear flat surface 1*b*. The liquid vessel 1 is provided with an opening 3 for introducing liquid into the vessel, and a closure cap 2 to seal the vessel after it has been filled with liquid. The lower portion of the front surface 1*a* of the liquid vessel converges toward its rear surface 1*b* for reasons which will hereinafter be explained.

The display apparatus of this invention comprises a generally circular housing or casing 5 formed to accommodate the liquid vessel 1. The casing 5 has a base 5*a* on which rests the flange portion 1*c* formed integrally with the liquid vessel 1. A background plate 6 is disposed intermediate the rear surface 1*b* of the liquid vessel and the casing 6 such that it provides a background view defining a liquid habitat for the swimming toy fish. Although the background plate 6 in the embodiment illustrated in FIG. 1 depicts a rock cave, it may be varied to depict a coral reef or other marine habitats, if desired.

Referring now specifically to FIG. 3, there is shown in the casing 5 behind the background plate 6, a pair of spaced-apart permanent magnets 7 and 8 which are vertically disposed at a predetermined distance from each other. The magnets 7 and 8, which serve to generate driving magnetic fields, are coupled to the rotatable shafts 9 and 10, respectively. The rotatable shafts 9 and 10 and the rotating magnets 7 and 8 are rotated at the same speed in the same direction by means of any suitable prime mover. Rotation of the magnets 7 and 8 in this manner permits the magnetic fields generated by these magnets to be alternately and regularly varied.

As is also shown in FIG. 3, a transmission gear member 11 is fixed to the revolving shaft 9 and drives this shaft, and a transmission gear member 12 is fixed to and drives the revolving shaft 10. The transmission gear 11 has a fewer number of teeth and is smaller in diameter than the transmission gear 12. A pair of intermediate gears 13 each include a smaller diameter pinion gear member 13*a* and a larger diameter gear wheel 13*b* both fixed to the same rotatable shaft. Each gear member 13*a* is engaged with a transmission gear 11 and 12, respectively, and the gear members 13*b* are engaged with the pinion 15 of the output shaft of motor 14 which acts as the prime mover. The arrangement described herein permits transmission gears 11 and 12 to be rotated at different speeds in the same direction. This results in generating magnetic fields which cross each other and which are alternatively and irregularly varied.

The ratio of rotation between the revolving shafts 9 and 10 may be suitably selected depending on the desired manner and directions of motion of the swimming toy fish, as hereinafter described. In the embodiment illustrated herein wherein the revolving shafts 9 and 10 are rotated at different speeds in the same direction, this ratio may be selected to be about 1:1.9.

Referring back to FIG. 3, the motor 14 is supported on support members 16*a* and 16*b* in the casing 5. A pair of opposed, spaced-apart parallel support members 17*a* define a structure in which the revolving shafts 9 and 10 as well as the intermediate gears 13 are rotatably supported.

A battery compartment 19 is disposed in the lower portion of the casing 5 and serves to hold one or more batteries (not shown) which are conveniently connected to the motor 14 for activating the motor.

Figure 4:
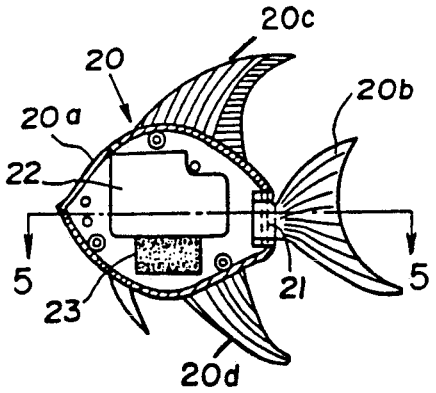
FIG. 4 is a vertical sectional view of a swimming toy fish made for use in the present invention.
Figure 5:
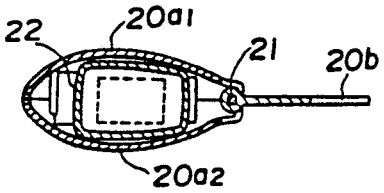
FIG. 5 is a sectional view taken along the line A—A of FIG. 4.

The swimming toy fish used in the display apparatus is generally designated by 20 and is suspended freely in the liquid medium 28 in the liquid vessel. In the embodiments of the invention described herein the fish 20 is made to simulate a tropical fish. As shown in FIGS. 4 and 5, the fish 20 has a body section 20*a* comprising half shells 20*a*1 and 20*a*2 made of a synthetic resin material. The half shells 20*a*1 and 20*a*2 may be joined together laterally by any suitable means such as by an adhesive. The fish 20 also includes a tail section 20*b*, also made of a synthetic resin material as in the half shells, pivotally secured to the body section 20*a* by means of a pivot pin 21. The fins 20*c* and 20*d* may be an integral part of the fish body section 20 or they may be formed separately and joined to the body section 20 by adhesive or other suitable means.

The swimming toy fish 20 also comprises an air vessel 22 such as a blow molded float which acts as an air tank, vertically disposed within the body section 20*a*. The air tank 22 acts as an air bladder in order to provide the fish with the desired degree of buoyancy in the liquid 28. Also disposed within the fish body section 20*a*, below the air tank 22 is a magnetic member 23 (FIG. 4). The air tank 22 and the fish magnet are constricted and arranged to provide proper balance between the buoyancy of the air tank and the weight of the fish magnet. This will permit the fish 20 to be freely suspended in the liquid 28 and simulate a natural fish in a water habitat.

Thus, the fish 20 is made of a density somewhat greater than the density of the swimming liquid 28. This will permit the fish 20 to sink in the liquid at a predetermined speed until it reaches the bottom of the liquid vessel in several seconds. The speed at which the fish 20 sinks in liquid 28 is preferably set in association with the speed at which the fish swims in the liquid.

While only one fish is illustrated in this embodiment, two or more swimming toy fish may be used in which case it may be desirable to select an appropriate size liquid vessel in order to accommodate the swimming movements of more than one toy fish.

Figure 6:
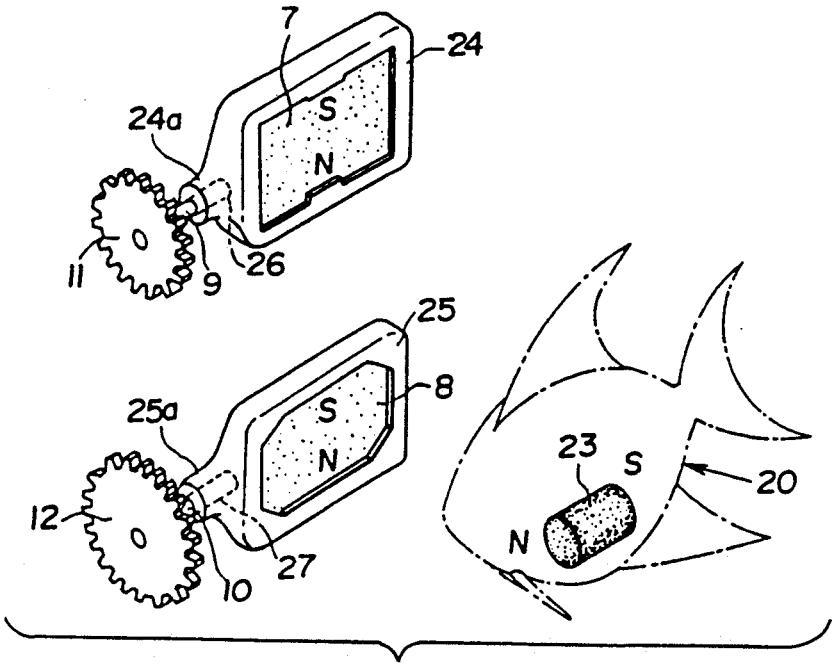
FIG. 6 is a schematic representation, partly perspective, showing the magnetic field relationship between the magnetic means in the toy fish and the driving magnets which are vertically disposed in the display apparatus of this invention.

As shown in FIG. 6, each of the rotating magnets 7 and 8, for generating driving magnetic fields, is fitted in support frames 24 and 25, respectively. The support frames 24 and 25 are provided, at the proximal ends thereof, with bosses 24*a* and 25*a* formed with apertures 26 and 27, respectively, into which is fixedly engaged the distal ends of the revolving shafts 9 and 10, respectively.

In use, the motor 14 is first activated by the battery. Activation of motor 14 causes rotation of the gears 11, 12 13*a* and 13*b*, resulting in rotation of the shafts 9 and 10 and corresponding rotations of the magnets 7 and 8 with respect to their main axis. As previously mentioned, this causes magnets 7 and 8 to be rotated at a predetermined ratio thus resulting in the generation of a variable magnetic field which causes a non-uniform magnetic action on fish magnet 23 in the swimming toy fish 20. More specifically, when the magnets 7 and 8 are rotated together in the same direction as aforesaid, magnetic fields generated by the magnets 7 and 8 move in the forward direction from below to above, and then in the rear direction from above to below, thereby causing mutual actions between the magnetic fields such as variation in strength of the magnetic force, repelling action due to magnetic repulsion, and attracting action due to magnetic attraction, and the like. Such magnetic field interactions will cause the swimming toy fish 20 to swim in all circulatory directions, vertical directions, longitudinal directions and lateral directions. In this manner, the swimming toy fish 20 simulates the swimming actions of a natural fish in a water habitat.

Figure 7:
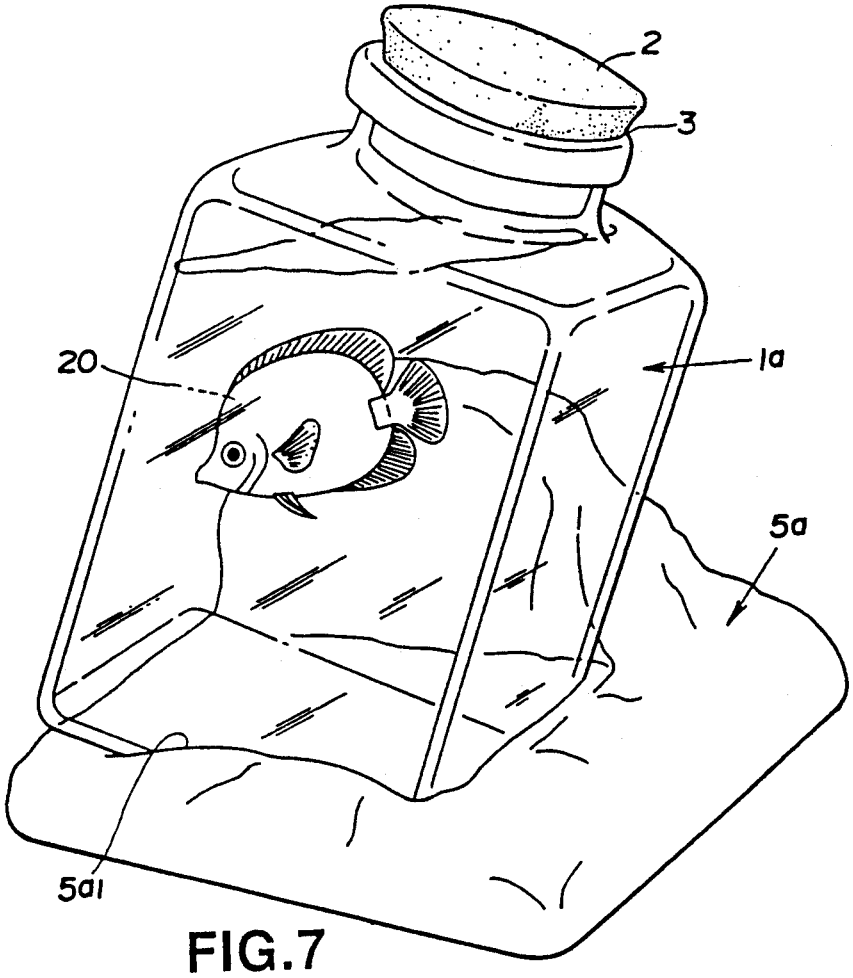
FIG. 7 is a perspective front view of another embodiment of a display apparatus and the swimming toy fish of the present invention.
Figure 9:
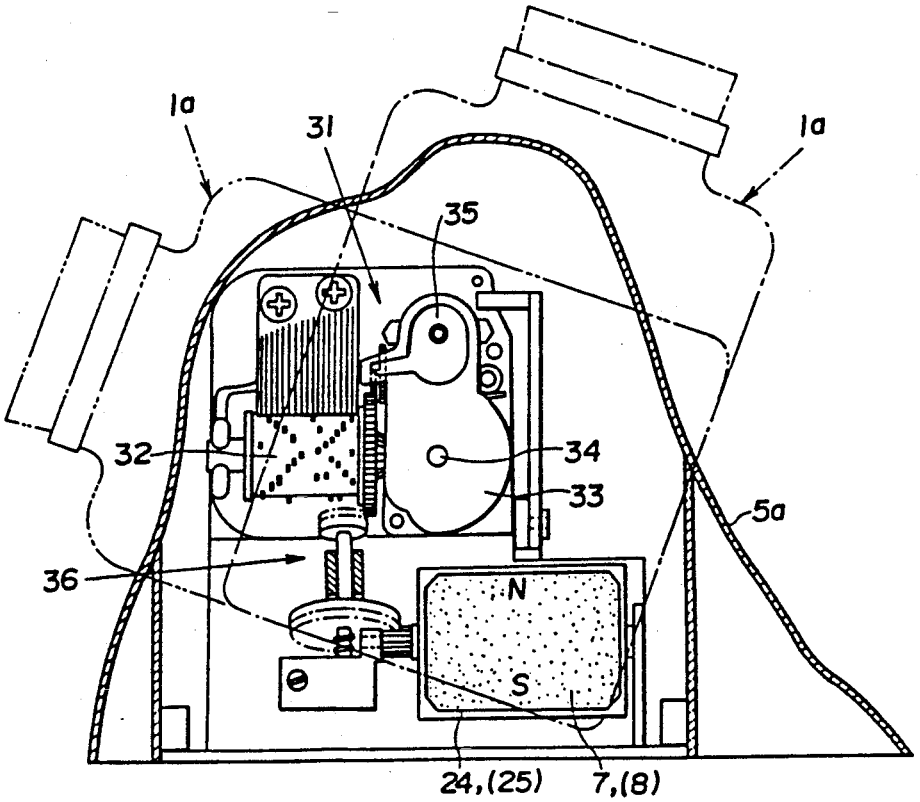
FIG. 9 is a partly cutaway cross-sectional view illustrating the interior structure of the display apparatus shown in FIG. 7.

Reference will now be made to FIGS. 7 and 9, which illustrate another embodiment of a swimming toy fish according to the present invention.

The swimming toy fish of the this embodiment is freely suspended in a transparent liquid vessel 1*a* shaped in the form of a conventional case bottle, and a casing 5*a* formed with a recessed surface 5*a*1 in which the bottom of the liquid vessel 1*a* and/or its side are at least partially fitted in a manner to be detachable with respect to the recess 5*a*1. Such constrictions of the liquid vessel 1*a* and casing 5*a* permit the swimming toy fish to be used for decorative purposes.

Figure 8:
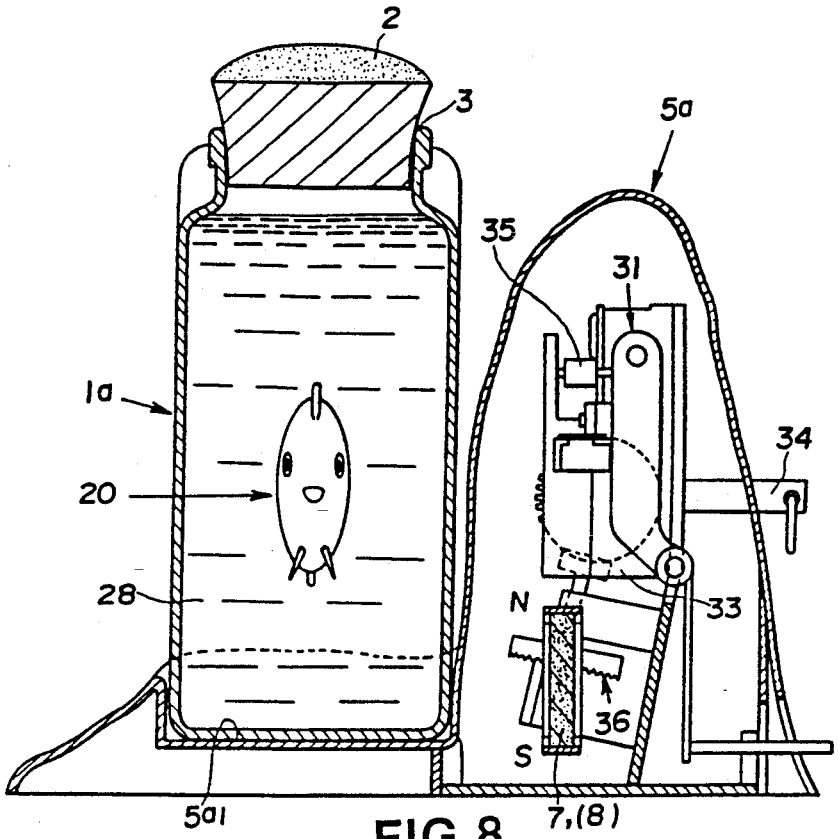
FIG. 8 is a vertical sectional view of the display apparatus shown in FIG. 7.

Also, the swimming toy fish of this embodiment, as shown in FIGS. 7, 8 and 9, includes a music box 31 disposed in the casing 5*a*. The music box 31 includes a drive member 33 comprising a coiled spring wound up by a wind-up shaft 34 or the like and a speed control mechanism. The output of the drive member 33 is transmitted to an interlocking mechanism 36 which is operatively connected between the drive member 33 and the rotating magnets 7 and/or 8 for generating driving magnetic fields. Such construction permits the toy fish 20 to swim due to rotation of the magnets 7 and 8, is carried out concurrently with actuation of the music box 31, thereby provide making it more appealing to a viewer. This construction eliminates the necessity for the electric drive motor 14 in the above-described embodiment, thus resulting in a more swimming toy simplified structure of the display apparatus for the swimming toy fish.

The remaining parts of the illustrated embodiment may be constructed in substantially the same manner as in the embodiment described above as shown in FIGS. 1 to 3.

Figure 10:
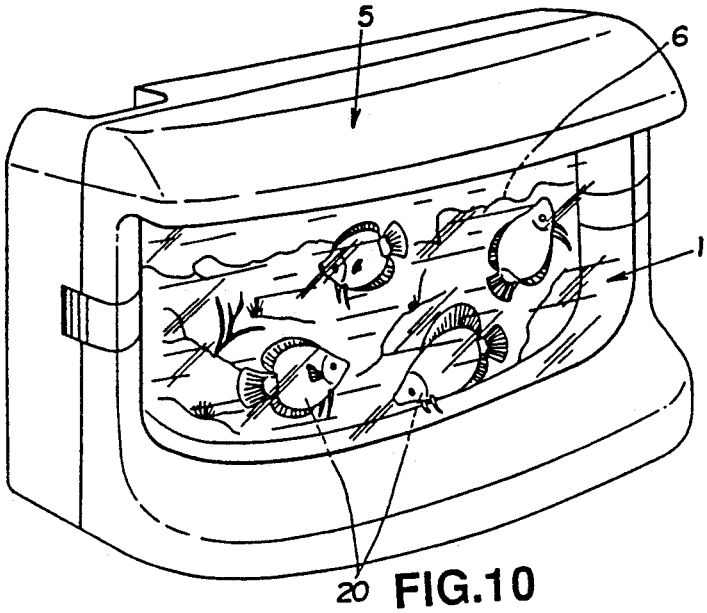
FIG. 10 is a perspective front view of a swimming toy fish in a marine display apparatus in accordance with the embodiment of this invention.
Figure 11:
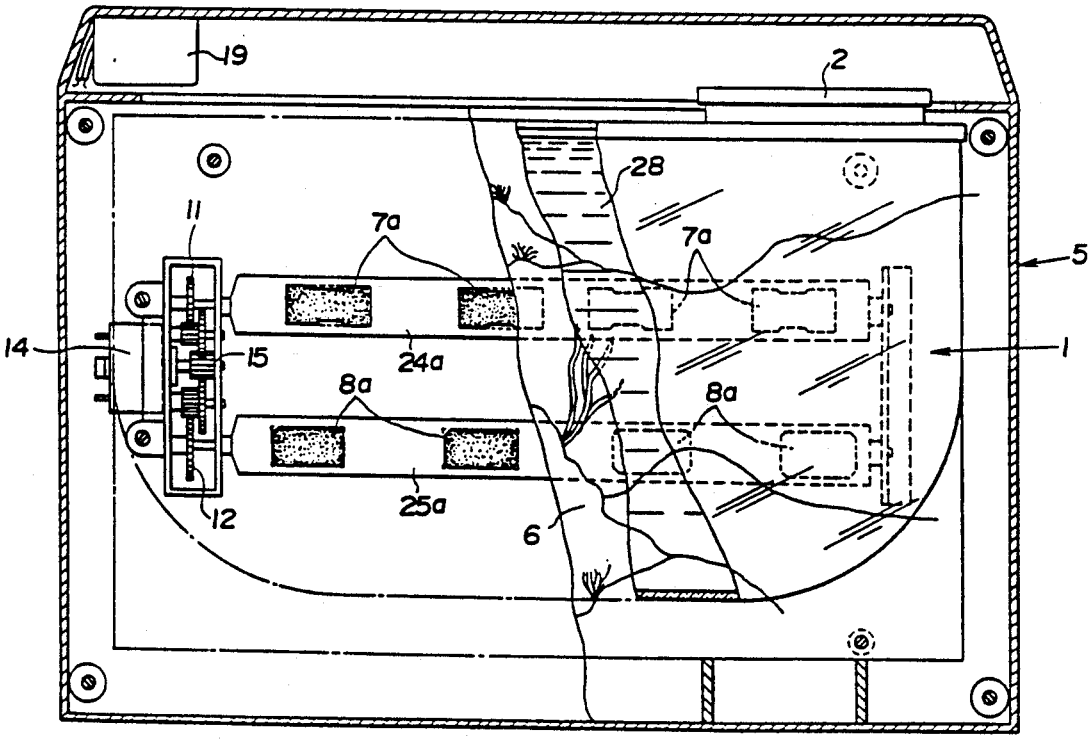
FIG. 11 is a cross sectional front view, in elevation, showing the interior structure of the display apparatus shown in FIG. 10.

References next made to FIGS. 10 and 11, showing a further embodiment of a marine display apparatus for a swimming toy fish according to the present invention. The swimming toy fish of this embodiment is so constructed that a plurality of swimming toy fish 20 are placed in swimming liquid 28, a plurality of rotating magnets 7*a* and 8*a* for generating driving magnetic fields are arranged at predetermined distances on elongated support frames 24*a* and 25*a*, in place of the combination of the support frames 24 and 25 and rotating magnets 7 and 8 in the above-described embodiments.

As can be seen from the foregoing description, the swimming toy fish of the present invention is so constructed that the rotating magnets for generating driving magnetic fields which are vertically arranged in stages at a predetermined interval are rotated at a predetermined ratio of rotation, thereby causing magnetic fields generated from the magnets to be varied with time. Such construction permits the magnetic fields to be varied magnetically to affect the magnet in the toy fish and permit it to be moved in different directions as desired. More particularly, it causes mutual actions between the magnetic fields resulting in a variation in strength of magnetic force, repelling action due to magnetic repulsion, attracting action due to magnetic attraction, and a follow-up action due to magnetic attraction. Such mutual magnetic actions affect the motions of the toy fish thereby permitting it to automatically swim in circulatory motions in all directions, and in vertical, longitudinal and lateral directions as desired. Thus, the toy fish 20 simulates the swimming actions of a live fish swimming in a water habitat.

While preferred embodiments of the invention have been described with a certain degree of particularity with reference to the drawings, several modifications and variations may be made which are obvious from the present disclosure. For example, only one rotating magnetic member, vertically disposed in the housing may be used behind the rear surface of the liquid vessel which co-acts with the magnet in the toy fish to cause the toy fish to swim in all directions. Such modifications and variations are nevertheless within the contemplation and scope of the invention claimed herein.

What is claimed is:

1. A marine display comprising a housing and a transparent liquid vessel at least partially filled with liquid, said liquid vessel having a front surface, a rear surface, an opening for introduction of liquid in said vessel and a closure means for sealing said opening so that the liquid is completely enclosed within said vessel;

a toy marine object suspended freely in said liquid, said toy marine object including a magnet and means to impart buoyancy to said marine object;

two vertically spaced apart rotatable magnetic members, each disposed in said housing behind said rear surface and rotatable about a horizontal axis, means for rotating said rotatable magnetic members, to generate a driving magnetic field, whereby said magnet in said toy marine object and said rotating magnetic members co-act to cause said toy marine object to move freely in all directions in said liquid simulating the swimming action of a natural marine object in a liquid habitat.

2. A marine display as in claim 1 wherein said marine object is a toy fish.

3. A marine display as in claim 1 wherein said marine object has a specific gravity greater than the specific gravity of the liquid so that the marine object can sink in said liquid at a predetermined speed.

4. A marine display as in claim 2 wherein said toy fish has a specific gravity greater than the specific gravity of the liquid so that the toy fish can sink in said liquid at a predetermined speed.

5. A marine display as in claim 1 wherein said rotating magnets are rotated in the same direction at different predetermined speeds of rotation.

6. A marine display as in claim 2 wherein said rotating magnets are rotated in the same direction at different predetermined speeds of rotation.

7. A marine display as in claim 3 wherein said rotating magnets are rotated in the same direction at different predetermined speeds of rotation.

8. A marine display as in claim 4 wherein said rotating magnets are rotated in the same direction at a predetermined speeds of rotation.

9. A marine display as in claim 1 wherein said front surface is convex.

10. A marine display as in claim 2 wherein said front surface is convex.

11. A marine display as in claim 3 wherein said front surface is convex.

12. A marine display as in claim 4 wherein said front surface is convex.

13. A marine display as in claim 5 wherein said front surface is convex.

14. A marine display as in claim 6 wherein said front surface is convex.

15. A marine display as in claim 7 wherein said front surface is convex.

16. A marine display as in claim 8 wherein said front surface is convex.

17. A marine display as in claims 1, 2, 3, 4, 5, 6, 7, 8, 9, 10, 11, 12, 13, 15 or 16 wherein a background plate is disposed in said housing behind the rear surface of said liquid vessel.

18. A marine display as in claim 1 wherein said rotatable magnetic members are rotated at different speeds.

* * * * *